United States Patent [19]

Blockley et al.

[11] 4,357,910

[45] Nov. 9, 1982

[54] MULTI-PASS HELICAL COIL THERMAL FLUID HEATER

[76] Inventors: Eugene T. Blockley; James A. Bell, both of 640 Sam Newell Rd., P.O. Box 1395, Matthews, N.C. 28105

[21] Appl. No.: 211,442

[22] Filed: Nov. 28, 1980

[51] Int. Cl.[3] ..... F22B 37/10

[52] U.S. Cl. ..... 122/248; 165/163

[58] Field of Search ..... 122/247, 248, 249, 250 R, 122/250 S, 245; 165/163

[56] References Cited

U.S. PATENT DOCUMENTS

| | | | |
|---|---|---|---|
| 373,783 | 11/1887 | Musil . | |
| 529,204 | 11/1894 | Simpson | 122/248 |
| 737,346 | 8/1903 | Chenhalls . | |
| 1,266,281 | 5/1918 | Lapp . | |
| 2,158,735 | 5/1939 | Vigneault | 122/248 |
| 2,566,627 | 9/1951 | Paulsen | 122/248 |
| 2,645,210 | 7/1953 | Harris et al. | 122/248 |
| 3,359,949 | 12/1967 | Bjarnason et al. | 122/248 |
| 3,529,579 | 9/1970 | Wanson | 122/248 |
| 3,753,423 | 8/1973 | Olson et al. | 122/248 |
| 3,841,273 | 10/1974 | Finger et al. | 122/248 |
| 4,044,727 | 8/1977 | Rychen et al. | 122/449 |

FOREIGN PATENT DOCUMENTS

| | | | |
|---|---|---|---|
| 505241 | 8/1954 | Canada . | |
| 52-15902 | 5/1977 | Japan | 122/248 |
| 394204 | 6/1933 | United Kingdom . | |

*Primary Examiner*—Edward G. Favors

*Attorney, Agent, or Firm*—Bell, Seltzer, Park & Gibson

[57] ABSTRACT

This invention relates to a multi-pass helical coil thermal fluid heater of improved thermal efficiency. The thermal fluid is heated while being circulated within concentric helical coils of the heater which are arranged in such a manner to improve overall thermal efficiency and simplify construction. Provision is also made for preheating of the thermal fluid and the heater combustion air to further improve thermal efficiency.

10 Claims, 3 Drawing Figures

MULTI-PASS HELICAL COIL THERMAL FLUID HEATER

FIELD OF THE INVENTION

This invention relates to a multi-pass helical coil heater of improved design and thermal efficiency for the heating of high temperature type heat transfer thermal fluids.

BACKGROUND OF THE INVENTION

Thermal fluid heaters have been used in the past when it has been desired to have an indirect heat source for downstream heat requirements and when for various reasons it has been undesired to use steam under pressure as the heat transfer medium. As opposed to traditional steam boilers which use water/steam under pressure as a heat transfer medium, thermal fluid heaters utilize a thermal fluid such as an inert synthetic oil which has a relatively high boiling point (such as 650° F.) to provide a heat supply source and system that may be operated essentially at atmospheric pressure and which avoids the corrosive side effects of water/steam as a heat transfer medium. Conventional thermal fluid heaters, however, have had their own shortcomings, especially in the form of possessing less than optimum thermal heat transfer efficiencies.

One particular aspect of thermal fluid heaters that has led to sub-optimum heat transfer efficiency has been that the thermal fluids used therein have particular maximum temperatures (depending on the particular fluid used) at which point, if they are heated beyond, they begin to decompose and break down into heavier hydrocarbon substances. This can eventually lead to the fouling of the fluid transfer apparatus and the rendering of the entire system inoperative until time consuming and costly purging is performed. This has meant that extreme care has had to be taken in the design, construction and operation of thermal fluid heaters to ensure, even by application of extremely conservative safety factors, that the maximum operating temperature of the thermal fluid would not be exceeded at any point in the heater.

The typical thermal fluid heater is usually cylindrical in shape with a gas or oil fired jet burner mounted on one end thereon and with a cylindrical helically wound pipe coil interior of and running the length of the heater. The burner is typically fired down the center of the heater with the combustion flames and gases heating the surrounding helically wound coil and also the thermal fluid contained in the coil and being pumped therethrough. However, the aforementioned susceptibility of the thermal fluid to breakdown has complicated the design and operation of such heaters in that there are certain areas or "hot spots" in such heaters at which the temperature of the helical coil, and the fluid therein, has proved to be greater than that at other points; indeed, one particularly hot area has been found to be at the terminal end of the coil furthest from the combustion burner at which area it has been found that the flame from the burner has tended to rise and spread and even contact portions of the coil. Attempts made to avoid overheating of the thermal fluid have not truly recognized the cause of the problem and have led to even further shortcomings. For example, to avoid overheating it has been suggested to operate the burner at reduced heat generating capacity, or to construct the heater and heater coil of an enlarged and non-optimum size, to avoid flame contact anywhere on the coil. Yet all of such attempts have only resulted in heater operation with substantially less than overall optimum thermal efficiency and heater designs in which the true problem present was not faced or solved.

Efforts were made to increase the resulting reduced thermal efficiency of such heaters but these likewise did not meet the basic overheating problem. Multiple helical coils were provided in order to have increased heat transfer area in a given sized heater package. Alternatively, substantial insulating and refractory material were provided in the interior of such heaters to retain and reflect inwardly the heat generated by the combustion burner, but such material has been found to be highly susceptible to material failure in sustained heater operation so as to create substantial repair and replacement problems. Even preheating of combustion air, just prior to its being introduced to the combustion burner, has been suggested in an attempt to improve heater efficiency, but as stated none of these efforts have truly recognized or solved the true problem.

SUMMARY OF THE INVENTION

The present invention overcomes the above disadvantages by providing a multi-pass helical coil thermal fluid heater of improved thermal efficiency in which the coil arrangement utilized avoids undesired thermal fluid overheating and breakdown.

Another object of the invention is to provide a multi-pass helical coil thermal fluid heater with predetermined length to transverse dimensional relationship so as to provide an optimum sized overall heater package.

Another object of the invention is to provide a multi-pass helical coil thermal fluid heater with a self-preheated combustion air source.

Another object of the invention is to provide a multi-pass helical coil thermal fluid heater with a self-preheater for the thermal fluid used therein.

Another object of the invention is to provide a multi-pass helical coil thermal fluid heater of such improved thermal efficiency that the need for interior insulating or refractory material is altogether avoided or at least substantially alleviated.

BRIEF DESCRIPTION OF THE DRAWINGS

Some of the objects and features of this invention having been stated, others will become more apparent as the description proceeds, when taken in connection with the accompanying drawings, in which.

DETAILED DESCRIPTION OF INVENTION

While the present invention will be described hereinafter with reference to the accompanying drawings, in which an operating embodiment in accordance with the present invention has been illustrated, it is to be understood at the outset that persons skilled in the applicable arts will be able to modify the apparatus of this invention while achieving the favorable result sought. For that reason, the description which follows is to be understood as a broad, teaching disclosure directed to persons of appropriate skill in the appropriate arts, and not as limiting upon this invention.

Figure 1:
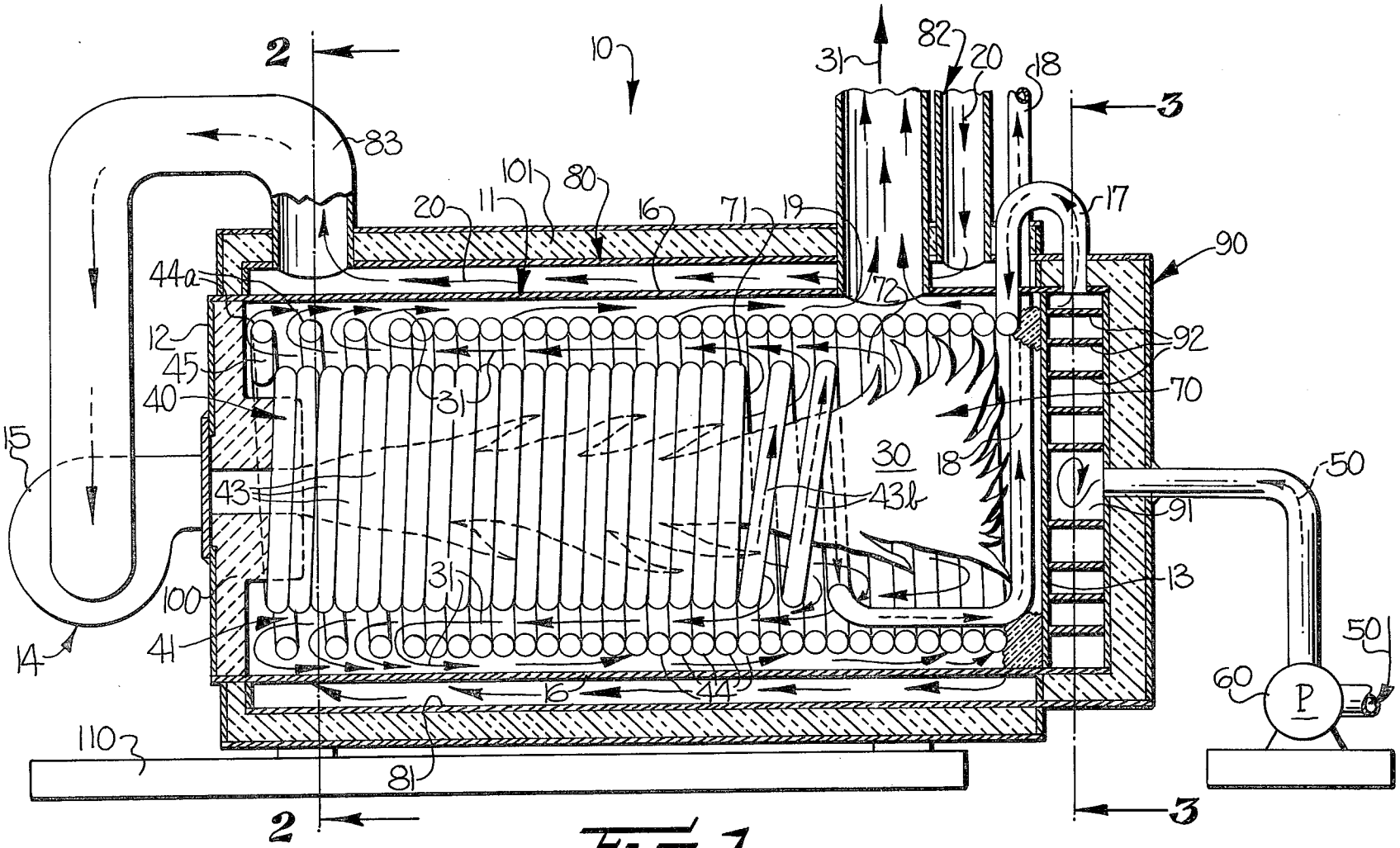
FIG. 1 is a side elevation of the invention with the body and interior portions shown in section.
Figure 2:
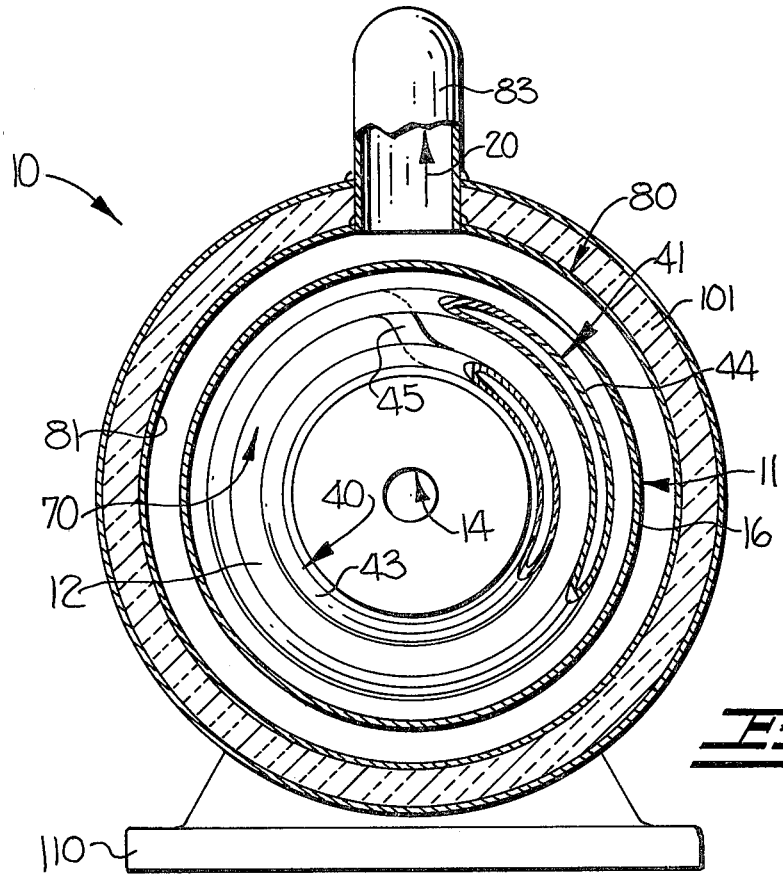
FIG. 2 is a sectional view along the line 2—2 of FIG. 1.
Figure 3:
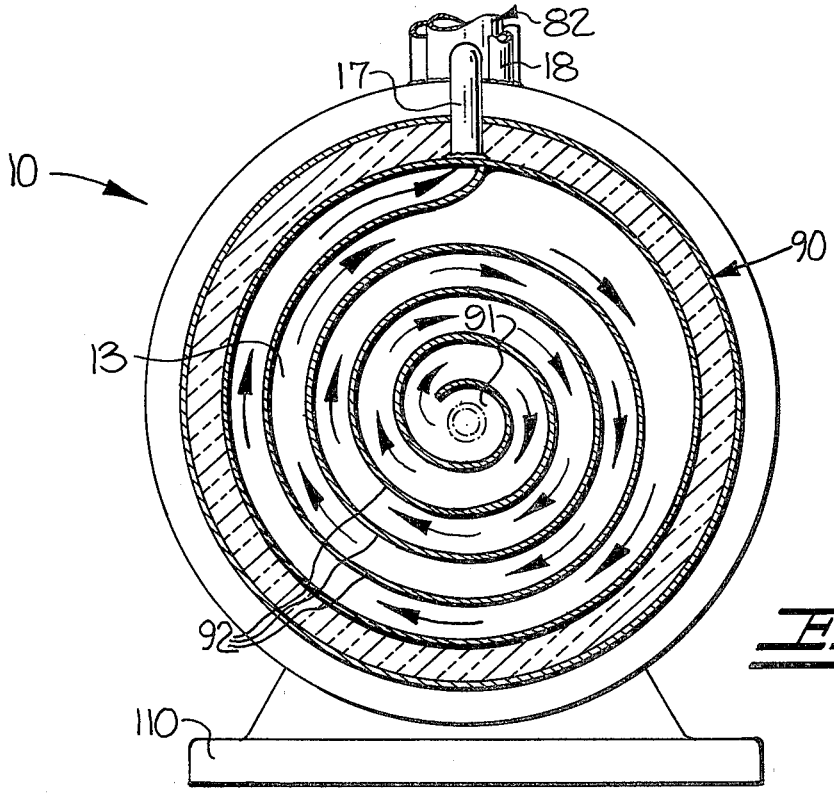
FIG. 3 is a sectional view along the line 3—3 of FIG. 1.

Referring now more particularly to the drawings, the heater 10 of the invention is shown in the generally preferred form in FIG. 1. As illustrated therein and as more specifically shown in FIGS. 2 and 3, the heater 10 comprises an elongate body 11 which is preferably cylindrical in shape as shown in FIGS. 2 and 3. The elongate body 11 has at its ends a first end wall 12 and a second end wall 13 in opposing relationship to one another, and these end walls are preferably circular shaped.

The primary heat source for the heater is a combustible fluid jet burner 14 which is supported on the first end wall 12 and preferably centrally located thereon. Combustion air 20 originating from the atmosphere is ultimately introduced to a blower 15 which acts as a means for supplying a relatively high rate stream of combustion air to the jet burner 14. Also supplied to the jet burner is a combustible fluid (not shown) such as a liquid hydrocarbon fuel or a combustible gas which is ignited in the jet burner 14 in the presence of the stream of combustion air 20 to burn same and produce substantial heat. The combustion of the combustible fluid is manifested in a flame 30 which extends from the jet burner 14 outwardly along the central portion of the heater body 11 toward the second end wall 13.

Substantially concentrically arranged within the heater body 11 are a first heat transfer unit 40 and a second heat transfer unit 41 each comprising a helically arranged coil of pipe tubing desirably of uniform pipe diameter which is preferably cylindrical in shape. Preferably the first heat transfer unit 40 comprises a first helical coil 43 and the second heat transfer unit 41 comprises a second helical coil 44, with the first helical coil of a smaller inside diameter than that of the second helical coil 44 and disposed within same in a radially spaced relation. The first and second heat transfer units, 40 and 41 respectively, are communicating with each other by a portion of tubing 45 between the respective helical coils, 43 and 44, as shown in both FIGS. 1 and 2. The second helical coil 44 is arranged in radially spaced relation with the side wall 16 of the elongate body 11 and this relationship as well as the spaced relationship with the first helical coil 44 is maintained by structural spacer elements (not shown).

A heat transfer fluid 50 is circulated through the first and second helical coils, 43 and 44 respectively, whereby heat generated by the combustion of the combustible fluid by the jet burner 14 is transferred to the circulating fluid 50 for subsequent use downstream of the heater 10. This heat transfer fluid 50 may be a synthetic hydrocarbon oil and desirably has an elevated boiling point (such as about 650° F.) whereby the fluid 50 preferably may be heated substantially without vaporizing.

As for routing of flow, the fluid 50 is desirably directed first to the second helical coil 44 by way of an intake pipe 17. The fluid 50 is then circulated through the entirety of the second helical coil 44 and then through the entirety of the first helical coil 43, after which the fluid which has thus been heated is directed to an exhaust pipe 18 for routing to downstream uses where heat is desired. Typically this downstream routing is through a closed loop system so that the fluid from which the heat has been removed eventually returns to the heater 10 for reheating without any need for replenishment. Also in the system, usually just prior to the heater 10, is a means for circulating the fluid 50 through the coils, 43 and 44, of the heater 10, said circulating means being in the form of a conventional motor driven fluid pump 60 (schematically shown).

The first and second helical coils, 43 and 44 respectively, are preferably arranged in the manner shown in FIG. 1 for desired heat transfer and thermal efficiency. Specifically, the second helical coil 44 has its coils extending from adjacent the first end wall 12 of the body 11 to adjacent the second end wall 13 thereof thereby being positioned to surround at least substantial portions of the first helical coil 43 and extending beyond the terminal end of the first helical coil 43. The first helical coil 43 has its coils extending outwardly from adjacent the first end wall 12 of the body 11 toward the opposing second end wall 13 and terminating at a terminal end location which is spaced from the second end wall 13. This positioned arrangement of the coils 43 and 44 forms an elongate combustion chamber 70 within the elongate body 11 with the first helical coil 43 serving to define a substantial first portion 71 of the combustion chamber 70 and with that portion of the second helical coil 44 extending beyond the terminal end **43*a* of the first helical coil 43 defining an enlarged cross sectional area second portion 72 of the combustion chamber 70**.

This foreshortening of the inner first helical coil 43 is desired in operation because it allows the jet burner 14 to be fired to desired combustion capacity without having the combustion flame 30 come into undesired contact with the terminal end of the first helical coil 43 as the flame 30 would if the terminal end of the first helical coil 43 extended to adjacent the second end wall 13. Such could otherwise occur, since as the flame 30 extends from the jet burner 14 toward the second end wall 13 it "lifts" and expands radially toward the side wall 16 of the elongate body 11. Direct flame contact of the first helical coil 43 is extremely undesirable since it could likely result in deleterious overheating of the heat transfer fluid 50. Optimumly the first helical coil 43 terminates at a location which is spaced from the second end wall 13 a distance of at least 20% up to about 25% of the overall distance between the first and second end walls, 12 and 13 respectively, so that the second portion 72 of the combustion chamber 70 is at least about 20% to about 25% of the overall length of the combustion chamber 70. It has been determined that such a predetermined foreshortening of the interior first helical coil provides for proper burner firing and sufficient heating of the first helical coil 43, while avoiding flame contact.

Furthermore, arranged and spaced apart as they have been described above, the first and second helical coils, 43 and 44 respectively, cooperate with each other and the interior of the side wall 16 of the body 11 so as to define a sinuous heat flow passageway for hot combustion gases 31 from the area of the flame 30 to between the first and second helical coils, 43 and 44 respectively, to between the interior of the side wall 16 of the body 11 to exhaust the products of combustion from the heater 10 through an exhaust exit 19 that thusly communicates with the combustion chamber 70. The spacing between the first and second helical coils, 43 and 44 respectively, as well as the spacing between the second helical coil 44 and the side wall 16 of the body 11 should be a predetermined distance of from about two to three inches to about as great as the outside diameter of the pipe tubing comprising the coils to provide for desired combustion gas velocity to accomplish sufficient heat transfer and to allow sufficiently unrestricted flow of the gases 31.

Additionally, at least the last two turns 43*b* of the terminal end of the first helical coil 43 are spaced apart from one another and from the remaining turns of the first helical coil 43 a predetermined distance of from about two inches to about as great as the outside diameter of the pipe tubing comprising the first helical coil 43, and at least the first two turns 44*a* of the second helical coil 44 adjacent the first end of the second helical coil 44 are spaced apart from one another and from the remaining turns of the second helical coil 44 a distance at least as great as the outside diameter of the pipe tubing comprising the second helical coil 44 to allow for thermal expansion of the coils and facilitate in defining the sinuous heat flow passageway for the hot combustion gases 31, as well as to obtain enhanced heat transfer to the spaced apart turns of tubing. As shown in FIG. 1, the plurality of turns of both the first and second helical coils, 43 and 44 respectively, are arranged in substantial contact with one another to further define the passageway for the hot gases 31.

In the illustrated embodiment of the heater 10 an exterior elongate jacket 80 of cylindrical shape is connected to the elongate body 11 adjacent its first and second end walls, 12 and 13 respectively, and positioned in surrounding radially spaced relationship to the body 11 defining a combustion air preheating chamber 81. Port means 82 in the form of an inlet air pipe communicatively connected to the jacket 80 and communicating with the combustion air preheating chamber 81 permits introduction of ambient air from the atmosphere into the preheating chamber 81 for preheating by residual heat from the burner 14 not transferred to the fluid circulating in the heater coils, 43 and 44. The preheated combustion air 20 then exits the preheating chamber 81 through an outlet air pipe 83 which serves as a means connected to the exterior jacket 80 and to the blower 15 of the jet burner 14 for directing the flow of preheated combustion air 20 to the jet burner 14 whereby the burner 14 may operate more efficiently by way of introduction of preheated combustion air 20 thereto. Alternatively, the blower 15 may be positioned upstream of the point of connection of the port means 82 to the jacket 80 in order to avoid subjecting the blower 15 to preheated air. While this combustion air preheating is preferred for increased thermal efficiency, in certain applications it may be omitted if the heater 10 is determined to be of sufficient efficiency for the particular application, or if it might result in such cooling of the heater body 11 to cause possible corrosion problems from cooled combustion gases 31.

As a further means of increasing the overall heat transfer efficiency of the heater 10, there is also preferably provided a third heat transfer unit 90 which is positioned adjacent to and in heat transfer relationship to the second end wall 13. This third heat transfer unit is desirably of generally circular shape being of substantially the same diameter as the circular second end wall 13 and substantially including the entirety of same.

In operation the heat transfer fluid 50 is introduced into the central portion 91 of the third heat transfer unit 90 and then circulated radially outwardly by being directed against means in the form of a convolute wall 92 which outwardly and convolutely circulates the heat transfer fluid 50 therein in order to retain the fluid 50 in such third unit 90 a sufficient length of time so as to accomplish even more efficient transfer of heat to the heat transfer fluid 50 therein. The third heat transfer unit 90 as shown is communicatively connected to said first and second heat transfer units, 40 and 41 respectively, so that the fluid 50 is desirably circulated to consecutively flow from the third heat transfer unit 90 to the second heat transfer unit 41 to the first heat transfer unit 40. This all provides even more efficient transfer of heat to the heat transfer fluid 50 in the third heat transfer unit 90 and the heater 10 overall.

In the heater 10 of the invention, due to the improved and superior thermal efficiency thereof the need for interior thermal insulation or refractory material has been essentially eliminated. This is highly advantageous since such internal material is typically highly susceptible to material failure in sustained heater operation. This leads to substantial repair and replacement problems since once the heater has been assembled and installed it presents a monumental task to thereafter gain access to its interior and repair or replace insulation or refractory material along the heater body side wall 16. In the heater 10 of the invention, a limited amount of refractory material 100 is provided adjacent the burner 14 and the first end wall 12 to shield this high temperature area and also since the rigidity of such material aids in the supporting of the burner 14.

In lieu of such internal insulation, adequate heat insulation may be obtained by providing external heat insulating means in the form of a layer of heat insulating material 101 such as mineral wool about the exterior of the heater 10 so as to substantially cover the length of the elongate body 11 and the second end wall 13 thereof so that all three of the heat transfer units are thermally insulated (or the first and second such units if the third is omitted) from their environs to provide increased thermal efficiency of the heater and to prevent possibly harmful inadvertent contact with a hot heater body.

As shown the heater 10 of the invention is presented in horizontal attitude on a stand 110, although it may be erected in vertical configuration. In addition to the heater 10, the fluid pump 60 may be assembled on the stand 110, as well as other associated valving and instrumentation making the heater installation a modular one.

The various capacities and dimensions of outputs of the heater 10 and its components such as the burner 14, blower 15 and coils, 43 and 44, may vary depending on the heat output required and the installation space available. However, it has been determined that having the elongate combustion chamber 70 of the heater of an overall length of from about 2.7 to about 3 times the transverse dimension or diameter of the first portion 71 of the combustion chamber results in an overall heater size and capacity of optimum physical size compared to heat generation yield.

In the drawings and specification, there has been set forth a preferred embodiment of the invention, and although specific terms are employed, they are used in a generic and descriptive sense only and not for purposes of limitation.

That which is claimed is:

1. A multi-pass helical coil thermal fluid heater comprising an elongate body having opposing first and second end walls and having an elongate combustion chamber therein and an exhaust exit communicating with the combustion chamber for discharge therefrom of the products of combustion, a combustible fluid jet burner supported on said first end wall of said body and including means for supplying a relatively high rate stream of combustion air for effecting the desired combustion and wherein the flame of combustion extends from the burner substantially to said opposing second end wall and is of an expanded cross section adjacent said second end wall, first and second heat transfer units each comprising a helically arranged coil of tubing communicating with each other and substantially concentrically arranged within said body with said first helical coil disposed within said second helical coil and with said coils being in radially spaced relation to each other and in radially spaced relation to the interior of the body and cooperating with each other and the interior of the body so as to define a sinuous heat flow passageway for hot combustion gases being discharged from the exhaust exit, means for circulating a heat transfer fluid through said first and second helical coils, said first helical coil serving to define a substantial first portion of the combuston chamber and having its coils extending outwardly from adjacent said first end wall of said body toward said opposing second end wall and terminating at a location which is spaced from said second end wall a distance of at least 20% of the overall distance between said first and second end walls, said second helical coil being positioned to surround at least substantial portions of said first helical coil and extending beyond the terminal end of said first helical coil to adjacent the second end wall so as to define an enlarged cross sectional area second portion of the combustion chamber of at least about 20% of the overall length of the combustion chamber whereby direct contact between the expanded flame area and the smaller size first helical coil adjacent said second wall is substantially avoided so as to prevent deleterious overheating of the heat transfer fluid circulating therethrough, and wherein at least the last two turns of the terminal end of the first helical coil are spaced apart from one another and from the remaining turns of the first coil a predetermined distance, and wherein at least the first two turns of the second helical coil adjacent the first end wall are also spaced apart from one another and from the remaining turns of the second coil a predetermined distance so as to provide for thermal expansion of said coils and also to provide communication of flow of the hot combustion gases from between the first and second helical coils into and between the second helical coil and the interior of said body, to thereby facilitate in defining the sinuous heat flow passageway for the hot combustion gases.

2. A multi-pass helical coil thermal fluid heater comprising an elongate body having opposing first and second end walls and having an elongate combustion chamber therein and an exhaust exit communicating with the combustion chamber for discharge therefrom of the products of combustion, a combustible fluid jet burner supported on said first end wall of said body and including means for supplying a relatively high rate stream of combustion air for effecting the desired combustion and wherein the flame of combustion extends from the burner substantially to said opposing second end wall and is of an expanded cross section adjacent said second end wall, first and second heat transfer units each comprising a helically arranged coil of tubing communicating with each other and substantially concentrically arranged within said body with said first helical coil disposed within said second helical coil and with said coils being in radially spaced relation to each other and in radially spaced relation to the interior of the body and cooperating with each other and the interior of the body so as to define a sinuous heat flow passageway for hot combustion gases being discharged from the exhaust exit, means for circulating a heat transfer fluid through said first and second helical coils, said first helical coil serving to define a substantial first portion of the combustion chamber and having its coils extending outwardly from adjacent said first end wall of said body toward said opposing second end wall and terminating at a location which is spaced from said second end wall a predetermined distance, said second helical coil being positioned to surround at least substantial portions of said first helical coil and extending beyond the terminal end of said first helical coil to adjacent the second end wall so as to define an enlarged cross sectional area second portion of the combustion chamber whereby direct contact between the expanded flame area and the smaller size first helical coil adjacent said second wall is substantially avoided so as to prevent deleterious overheating of the heat transfer fluid circulating therethrough, wherein said first and second helical coils collectively define a combustion chamber having an overall length of from about 2.7 to about 3 times the transverse dimension of the first portion of the combustion chamber as defined by said first helical coil, and wherein at least the last two turns of the terminal end of the first helical coil are spaced apart from one another and from the remaining turns of the first coil a predetermined distance, and wherein at least the first two turns of the second helical coil adjacent the first end wall are also spaced apart from one another and from the remaining turns of the second coil a predetermined distance so as to provide for thermal expansion of said coils and also to provide communication of flow of the hot combustion gases from between the first and second helical coils into and between the second helical coil and the interior of said body, to thereby facilitate in defining the sinuous heat flow passageway for the hot combustion gases.

3. The thermal fluid heater of either claim 1 or 2 further comprising an exterior elongate jacket connected to said elongate body and positioned in surrounding radially spaced relation thereto defining a combustion air preheating chamber, port means communicatively connected to said jacket and communicating with the combustion air preheating chamber therein for introducing ambient air into the preheating chamber, means connected to said jacket and to said combustible fluid jet burner for directing the flow of preheated combustion air to said jet burner whereby said burner may operate more efficiently by way of introduction of preheated combustion air thereto.

4. The thermal fluid heater of either claims 1 or 2 further comprising means positioned in heat transfer relationship to said second end wall and substantially including the entirety of said second end wall and defining a third heat transfer unit and being communicatively connected to said first and second heat transfer units so that the heat transfer fluid circulating therethrough consecutively flows from said third heat transfer unit to said second heat transfer unit to said first heat transfer unit.

5. A multi-pass helical coil thermal fluid heater comprising an elongate body having opposing first and second end walls and having an elongate combustion chamber therein and an exhaust exit communicating with the combustion chamber for discharge therefrom of the products of combustion, a combustible fluid jet burner supported on said first end wall of said body and including means for supplying a relatively high rate stream of combustion air for effecting the desired combustion and wherein the flame of combustion extends from the burner substantially to said opposing second end wall and is of an expanded cross section adjacent said second end wall, first, second and third heat transfer units each communicating with each other, said first and second heat transfer units each comprising a helically arranged coil of tubing and substantially concentrically arranged within said body with said first helical coil disposed within said second helical coil and with said coils being in radially spaced relation to each other and in radially spaced relation to the interior of the body and cooperating with each other and the interior of the body so as to define a sinuous heat flow passageway for hot combustion gases being discharged from the exhaust exit, said third heat transfer unit being positioned in heat transfer relationship to said second end wall and substantially including the entirety of same, means for circulating a heat transfer fluid through said heat transfer units with the sequence of flow being from said third heat transfer unit to said second heat transfer unit to said first heat transfer unit, said first helical coil serving to define a substantial first portion of the combustion chamber and having its coils extending outwardly from adjacent said first end wall of said body toward said opposing second end wall and terminating at a location which is spaced from said second end wall, said second helical coil being positioned to surround at least substantial portions of said first helical coil and extending beyond the terminal end of said first helical coil to adjacent the second end wall so as to define an enlarged cross sectional area second portion of the combustion chamber whereby direct contact between the expanded flame area and the smaller size first helical coil adjacent said second wall is substantially avoided so as to prevent deleterious overheating of the heat transfer fluid circulating therethrough, and wherein at least the last two turns of the terminal end of the first helical coil are spaced apart from one another and from the remaining turns of the first coil a predetermined distance, and wherein at least the first two turns of the second helical coil adjacent the first end wall are also spaced apart from one another and from the remaining turns of the second coil a predetermined distance so as to provide for thermal expansion of said coils and also to provide communication of flow of the hot combustion gases from between the first and second helical coils into and between the second helical coil and the interior of said body, to thereby facilitate in defining the sinuous heat flow passageway for the hot combustion gases.

6. The thermal fluid heater of claim 5 wherein heat insulating means are provided to substantially cover the length of said elongate body and the second end wall thereof so that all three of said heat transfer units are thermally insulated from their environs to provide increased thermal efficiency of said heater.

7. A multi-pass helical coil thermal fluid heater comprising an elongate cylindrical body having opposing first and second circular end walls and having an elongate combustion chamber therein and an exhaust exit communicating with the combustion chamber for discharge therefrom of the products of combustion, a combustible fluid jet burner supported on and centrally located on said first circular end wall of said body and including means for supplying a relatively high rate stream of combustion air for effecting the desired combustion and wherein the flame of combustion extends from the burner substantially down the central axis of said cylindrical body and, substantially to said opposing second circular end wall and is of an expanded cross section adjacent said second end wall, first and second heat transfer units each comprising a helically arranged cylindrical coil of tubing communicating with each other and substantially concentrically arranged within said cylindrical body with said first helical coil disposed within said second helical coil and with said coils being in radially spaced relation to each other and in radially spaced relation to the interior of the body and cooperating with each other and the interior of the body so as to define a sinuous heat flow passageway for hot combustion gases being discharged from the exhaust exit, means for circulating a heat transfer fluid through said first and second helical coils, said first helical coil serving to define a substantial first portion of the combustion chamber and having its coils extending outwardly from adjacent said first end wall of said body toward said opposing second end wall and terminating at a location which is spaced from said second end wall a distance of at least 20% of the overall distance between said first and second end walls, and said second helical coil being positioned to surround at least substantial portions of said first helical coil and extending beyond the terminal end of said first helical coil to adjacent the second end wall so as to define an enlarged cross sectional area second portion of the combustion chamber of at least about 20% of the overall length of the combustion chamber whereby direct contact between the expanded flame area and the smaller size first helical coil adjacent said second wall is substantially avoided so as to prevent deleterious overheating of the transfer fluid circulating therethrough, and wherein at least the last two turns of the terminal end of the first helical coil are spaced apart from one another and from the remaining turns of the first coil a predetermined distance, and wherein at least the first two turns of the second helical coil adjacent the first end wall are also spaced apart from one another and from the remaining turns of the second coil a predetermined distance so as to provide for thermal expansion of said coils and also to provide communication of flow of the hot combustion gases from between the first and second helical coils into and between the second helical coil and the interior of said body, to thereby facilitate in defining the sinuous heat flow passageway for the hot combustion gases.

8. The thermal fluid heater of claim 7 further comprising means positioned in heat transfer relationship to said second end wall and substantially including the entirety of said second end wall and of substantially the same diameter thereof defining a third heat transfer unit of generally circular shape and being communicatively connected to said first and second heat transfer units so that the heat transfer fluid circulating therethrough consecutively flows from said third heat transfer unit to said second heat transfer unit to said first heat transfer unit.

9. The thermal fluid heater of claim 8 wherein the heat transfer fluid is introduced into the central portion of said third heat transfer unit and wherein said third heat transfer unit includes convolute wall means for outwardly and convolutely circulating the heat transfer fluid therein so as to accomplish more efficient transfer of heat to the heat transfer fluid in said third heat transfer unit.

10. The thermal fluid heater of claim 7 further comprising an exterior elongate cylindrical jacket connected to said elongate cylindrical body and positioned in surrounding radially spaced relation thereto defining an annular combustion air preheating chamber, port means communicatively connected to said jacket adjacent said second circular end wall and communicating with the combustion air preheating chamber therein for introducing ambient air into the preheating chamber, and means connected to said jacket and to said combustible fluid jet burner for directing the flow of preheated combustion air to said jet burner whereby said burner may operate more efficiently by way of introduction of preheated combustion air thereto.

* * * * *

UNITED STATES PATENT AND TRADEMARK OFFICE

CERTIFICATE OF CORRECTION

PATENT NO. : 4357910

DATED : November 9, 1982

INVENTOR(S) : Eugene T. Blockley; James A. Bell

It is certified that error appears in the above-identified patent and that said Letters Patent are hereby corrected as shown below:

Column 10, Claim 7, Line 64, before "transfer" insert --heat--.

Signed and Sealed this

Eighteenth Day of January 1983

[SEAL]

*Attest:*

GERALD J. MOSSINGHOFF

*Attesting Officer*

*Commissioner of Patents and Trademarks*